US006784620B1

(12) United States Patent
Peters

(10) Patent No.: US 6,784,620 B1
(45) Date of Patent: Aug. 31, 2004

(54) PLASMA FILTER

(75) Inventor: Christopher Wayne Peters, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/385,143

(22) Filed: Mar. 10, 2003

(51) Int. Cl.[7] ..... H01J 7/24
(52) U.S. Cl. ..... 315/111.21; 315/111.01
(58) Field of Search ..... 315/111.01, 111.21, 315/111.41, 111.81, 111.91; 118/723 R, 723 I, 623, 723 FI; H01J 7/24

(56) References Cited

U.S. PATENT DOCUMENTS 5,028,452 A * 7/1991 Beatty ..... 427/571
5,328,515 A * 7/1994 Chouan et al. ..... 118/723 ME
5,449,412 A * 9/1995 Pinneo ..... 118/723 MP
6,624,719 B1 * 9/2003 Anderson et al. ..... 333/99 PL
2002/0179015 A1 * 12/2002 Laermer et al. ..... 118/723 CB

* cited by examiner

*Primary Examiner*—Don Wong
*Assistant Examiner*—Trinh Vo Dinh
(74) *Attorney, Agent, or Firm*—Duane Morris LLP

(57) ABSTRACT

A low/band/high pass filter includes first and second plasmas, each with a path for the flow of electromagnetic energy at frequencies above the plasma frequency. A path for the flow of electromagnetic energy is coupled to the second port of the first plasma and to a first port of the second plasma. The plasma frequency of the second plasma is greater than that of the first plasma. Energy below the plasma frequency of the first plasma is reflected from the first port of the first plasma, and energy above the plasma frequency of the second plasma propagates to the second plasma. That energy above the plasma frequency of the first plasma but below the plasma frequency of the second plasma reflects from the second plasma and is coupled out of the system. That energy at a frequency above the second plasma frequency propagates through the second plasma.

33 Claims, 2 Drawing Sheets

PLASMA FILTER

FIELD OF THE INVENTION

This invention relates to filters for electromagnetic energy, and more particularly to such filters which use plasmas.

BACKGROUND OF THE INVENTION

Plasma is said to be the most common state of matter in the universe. In essence, a plasma is a state of matter in which the electrons of an atom are free from the remainder of the atom, whereby the remainder of the atom is electrically charged or ionized. Plasma has been of interest in the field of communications because of the presence of the ionosphere, which is a plasma lying above the earth's surface. It has long been known that the ionosphere would reflect electromagnetic radiation (also known generally as "radio-frequency" signals or radiation), so long as the frequency of the electromagnetic radiation was below a calculable frequency. The frequency at which the ionosphere reflects is known to vary as a function of at least the charged particle density of the ionosphere.

There is a body of knowledge about plasmas, set forth in texts such as *Fields and Waves in Communication Electronics* by Ramo, Whinnery, and Van Duzer, published 1994 by Wiley and *Introduction to Plasma Physics and Controlled Fusion*, by Chen, published 1994 by Plenum Press. In addition, the Internet is a source of information in regard to plasmas. A fundamental time-scale in plasma physics is the "plasma frequency." Such a plasma frequency exists for all conductors, where the term "conductor" refers to matter containing free electrons.

The plasma frequency $o_p$ is given by $$O_p^2 = \frac{ne^2}{\varepsilon_0 m} \quad (1)$$

where:

n is the charged particle density (charged particle/volume);

e is the charge of the ionized particle (ion or electron);

m is the mass of the charged particle; and o is permittivity of free space.

It will be clear that the plasma frequency is different as between the electron and the ion species, because of their different masses. The plasma frequency which is commonly referred to in the literature is the electron plasma frequency, which is much higher than the ion plasma frequency. The plasma frequency may be viewed simplistically as being the frequency in a conductor at which the electrons collectively oscillate relative to their ion cores. The plasma frequency may be conveniently measured in a manner analogous to the ionosphere propagation model, namely by applying an electromagnetic signal to the plasma, and determining the frequency at which reflection changes to propagation.

SUMMARY OF THE INVENTION

A frequency-sensitive apparatus according to an aspect of the invention comprises a first path for the flow of electromagnetic energy, and a first plasma lying in the first path. The first plasma has a first plasma frequency. A second plasma lies in the first path. The second plasma has a second plasma frequency, different from the first plasma frequency.

In a particular embodiment of the apparatus according to this aspect of the invention, an electromagnetic energy port is coupled to the first path at a location lying between the first and second plasmas. In another embodiment, a first circulator is provided. The first circulator defines first, second, and third ports, and first, second, third paths for the flow of circulator electromagnetic energy from the first port to the second port, from the second port to the third port, and from the third port to the first port, respectively. The first path for the flow of electromagnetic energy of the first circulator lies in the first path for the flow of electromagnetic energy, at a location along the first path for the flow of electromagnetic energy which lies between the first and second plasmas. In another embodiment of this aspect of the invention, a second circulator is provided, with the second circulator defining fourth, fifth, and sixth ports, and fourth, fifth, and sixth paths for the flow of second circulator electromagnetic energy from the fourth port to the fifth port, from the fifth port to the sixth port, and from the sixth port to the fourth port, respectively, of the second circulator. The fourth port is coupled to the first path for the flow of electromagnetic energy at a location, relative to the first plasma, which is remote from the first circulator. In particular embodiments of this aspect of the invention, a first voltage source is coupled to the first plasma for maintaining the first plasma at the first plasma frequency, and a second voltage source is coupled to the second plasma for maintaining the second plasma at the second plasma frequency. In one application of an apparatus according to this first aspect of the invention, a source of electromagnetic energy is coupled to the first path at a location adjacent the first plasma, for transmitting electromagnetic waves along the path toward the first plasma and the second plasma. In a particular application, the electromagnetic waves transmitted by the source of electromagnetic energy include a component at a frequency lower than the plasma frequency of the first plasma, whereby the component of the electromagnetic waves transmitted by the source of electromagnetic energy tends to be reflected by the first plasma. In another particular application of the apparatus according to this aspect of the invention, the electromagnetic waves transmitted by the source of electromagnetic energy include a component at a frequency lying between the plasma frequency of the first plasma and the plasma frequency of the second plasma, whereby the component of the electromagnetic waves transmitted by the source of electromagnetic energy tends to be passed by the first plasma and reflected by the second plasma. In this particular application, it may be advantageous if the apparatus further comprises electromagnetic signal coupling means coupled to the first path at a location lying between the first and second plasmas, for extracting the component of the electromagnetic energy at a frequency lying between the plasma frequency of the first plasma and the plasma frequency of the second plasma. In one version, the electromagnetic signal coupling means is directional. It may be a directional coupler. In yet another application of the apparatus according to this aspect of the invention, the electromagnetic waves transmitted by the source of electromagnetic energy include a component at a frequency lying above the plasma frequencies of the first plasma and the second plasma, whereby the component of the electromagnetic waves transmitted by the source of electromagnetic energy tends to be passed by the first and second plasmas. In such a version, the apparatus may advantageously include utilization means coupled to the first path at a location relative to the second plasma which is remote from the first plasma. In an application of the apparatus according to this aspect of the invention, where the electromagnetic waves transmitted by the source of electromagnetic energy include components having frequencies lying above the plasma frequency of the first plasma and other components having frequencies lying above the plasma frequency of the second plasma the apparatus according to this aspect of the invention may advantageously include electromagnetic signal coupling means, which may be directional, coupled to the first path at a location lying between the first and second plasmas, for extracting the component of the electromagnetic energy at a frequency lying between the plasma frequency of the first plasma and the plasma frequency of the second plasma. It may further advantageously include signal utilization means coupled to the first path at a location adjacent the second plasma and remote from the first plasma, for utilizing the component of the electromagnetic energy at a frequency lying above the plasma frequency of the second plasma. If the electromagnetic signal coupling means comprises a directional coupler, the coupler may define a path between first and second ports, and a third port, with the path between first and second ports lying in the first path at the location lying between the first and second plasmas, for coupling to the third port of the directional coupler the electromagnetic energy at a frequency lying between the plasma frequency of the first plasma and the plasma frequency of the second plasma which reflect from the second plasma. For those applications of the apparatus according to this aspect of the invention, where the source of electromagnetic energy further generates waves with components at frequencies below the plasma frequency of the first plasma, the apparatus may include coupling means lying between the source of electromagnetic energy and the first plasma, for extracting that component of the electromagnetic energy with components at frequencies below the plasma frequency of the first plasma which are reflected by the first plasma.

According to another aspect of the invention, a frequency-sensitive apparatus comprises a first plasma defining first and second ports, and a path for the flow of electromagnetic energy between the first and second ports of the first plasma at frequencies lying above a plasma frequency of the first plasma. A second plasma defines first and second ports, and a path for the flow of electromagnetic energy between the first and second ports of the second plasma at frequencies lying above a plasma frequency of the second plasma. A source of electromagnetic energy generates electromagnetic waves including at least one component. The component has a frequency which is one of (a) below the first plasma frequency, (b) between the first and second plasma frequencies, and (c) above the second plasma frequency. A first directional coupling means is provided. The first directional coupling means includes first, second, and third ports, for coupling signal in a directional manner, namely from the first port exclusively to the second port, from the second port exclusively to the third port, and from the third port exclusively to the first port. The second port of the first directional coupling means is coupled to the first port of the first plasma, for coupling to the third port of the first directional coupling means at least that component of the electromagnetic energy which reflects from the first plasma. The apparatus according to this aspect of the invention also includes second directional coupling means including first, second, and third ports, for coupling signal in a directional manner from the first port exclusively to the second port, from the second port exclusively to the third port, and from the third port exclusively to the first port. The first port of the second directional coupling means is coupled to the second port of the first plasma, and the second port of the second directional coupling means is coupled to the first port of the second plasma, for coupling to the third port of the second directional coupling means at least that component of the electromagnetic waves which reflects from the second plasma. In a particular version of this aspect of the invention, the apparatus further comprises utilization means coupled to the second port of the second plasma, for utilizing those components of the electromagnetic wave passing through the second plasma.

An apparatus according to another aspect of the invention includes a first plasma, and a first radio-frequency electromagnetic coupling means coupled to the first plasma, for defining first and second radio-frequency electromagnetic ports of the first plasma. This apparatus also includes a second plasma, and second radio-frequency electromagnetic coupling means coupled to the second plasma, for defining first and second radio-frequency electromagnetic ports of the second plasma. The apparatus according to this other aspect of the invention also includes a radio-frequency electromagnetic path extending from the second port of the first plasma to the first port of the second plasma, for coupling radio frequencies electromagnetic waves between the second port of the first plasma and the first port of the second plasma. In a version of this other aspect of the invention, the radio-frequency electromagnetic path comprises a directional coupler. In this version, the directional coupler may comprise first, second, and third ports, and it may couple (a) signals applied to the first port of the directional coupler to the second port of the directional coupler, (b) signals applied to the second port of the directional coupler to the third port of the directional coupler, and (c) signals applied to the third port of the directional coupler to the first port of the directional coupler. The first port of the directional coupler is coupled to the second port of the first plasma, and the second port of the directional coupler is coupled to the first port of the second plasma, for coupling to the third port of the directional coupler electromagnetic signals reflected from the first port of the second plasma. A second directional coupler may be used. The second directional coupler may define first, second, and third ports, for coupling (a) signals applied to the first port of the second directional coupler to the second port of the second directional coupler, (b) signals applied to the second port of the second directional coupler to the third port of the second directional coupler, and (c) signals applied to the third port of the second directional coupler to the first port of the second directional coupler. The second port of the second directional coupler is coupled to the first port of the first plasma, for coupling to the third port of the second directional coupler signals reflected from the first port of the first plasma.

DESCRIPTION OF THE INVENTION

Figure 1A:
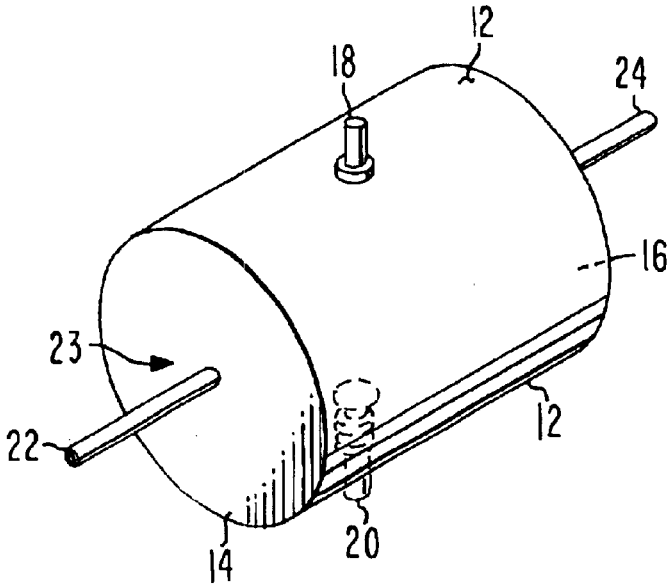
Fig. 1a PRIOR ART
FIG. 1*a* is a simplified perspective or isometric view of a plasma container.
Figure 1B:
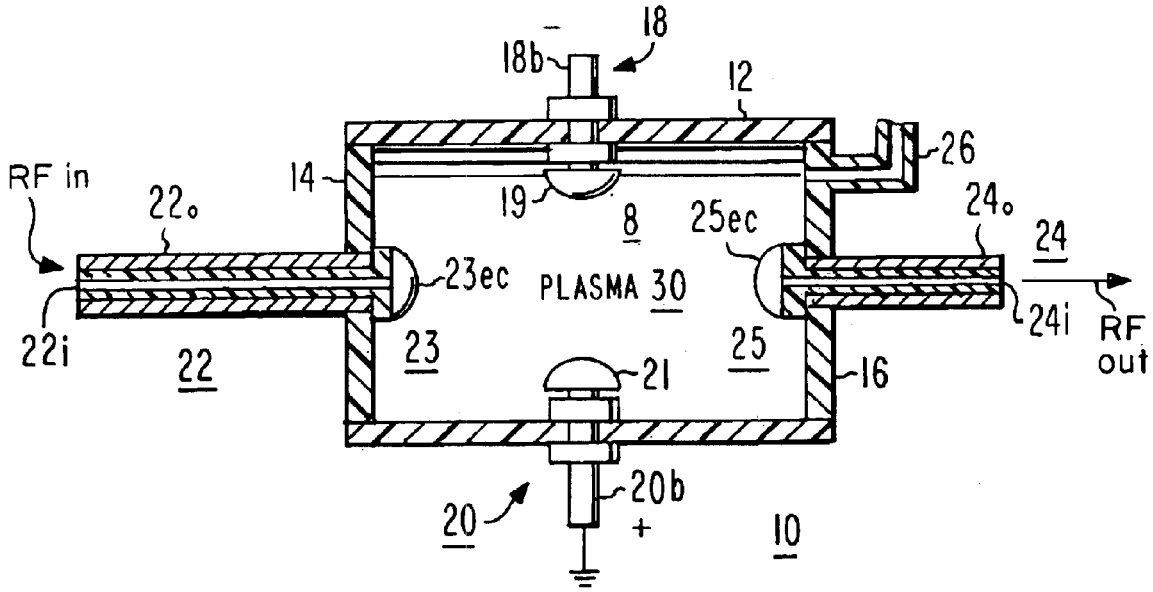
Fig. 1b PRIOR ART
FIG. 1*b* is a cross-section thereof.

In FIGS. 1*a* and 1*b*, a plasma container 10 includes a nonconductive or dielectric tubular body 12, illustrated as being in the shape of a cylinder. A first nonconductive or dielectric window 14 closes off one end of the tube defined by body 12, and a second similar window 16 closes off the other end of the tube, to thereby define an enclosed space 8. A port 26 opens into the enclosed space 8 to allow evacuation of atmosphere therefrom, and to allow introduction of the desired gas.

A first cathode electrode designated as 18 includes an electrically conductive body 18*b* which penetrates through body 12 in FIGS. 1*a* and 1*b*, and is sealed to prevent gas leakage between the outside world and the interior space 8. An electrically conductive rounded body 19 is illustrated as being connected to electrically conductive body 18*b*, for tending to spread electric field in a manner which tends to reduce arcing. A second anode electrode designated generally as 20 includes an electrically conductive body 20*b* which penetrates through body 12 in FIGS. 1*a* and 1*b*, and is sealed to prevent gas leakage between the outside world and the interior space 8. An electrically conductive rounded body 21 is illustrated as being connected to electrically conductive body 18*b*. Anode electrode 20 is illustrated as being connected to ground. In operation, a high voltage, negative with respect to ground, is applied to cathode terminal 18, for aiding in forming a plasma, illustrated as a cloud 30, within enclosed region 8. The breakdown of the gas in the enclosed space 8 of FIGS. 1*a* and 1*b* depends upon the gas used, the cathode construction, the gap between the cathode 18 and the anode 20, and the gas pressure.

In order to determine the plasma frequency in the plasma container 10 of FIGS. 1*a* and 1*b*, it is desirable to apply electromagnetic energy in the form of "radio waves" in order to determine if the energy reflects or is transmitted by the plasma. In order to apply electromagnetic energy to the plasma within enclosed space 8, a first electromagnetic transmission line in the form of a coaxial conductor pair (coax) 22 is coupled to the plasma by way of an antenna designated generally as 23. The transmission line 22 includes an outer conductor 22*o* and an inner conductor 22*i*. At least the inner conductor 22*i* penetrates through window or wall 14 in a sealing manner, and terminates in a structure 23*ec* which in antenna parlance is known as an "end cap." The end cap 23*ec* is an enlarged conductive region electrically connected to the inner conductor 22*i*, which tends to produce electromagnetic fields by virtue of its capacitance to the environment, and particularly by its capacitance to that portion of the outer conductor 22*o* located near the end cap 23*ec*. If electromagnetic energy at a particular frequency is applied to the plasma 30 by way of coax 22 and end cap 23*ec* of antenna 23, and is not reflected, it is desirable to know if the plasma has absorbed the energy, or if it has been coupled through the plasma. In many cases, there will be both absorption and transmission. In order to be able to determine the amounts of transmission and absorption, a second antenna designated generally as 25 is coupled to an electromagnetic transmission line 24. In particular, antenna 25 includes an end cap 25*ec* which is connected to the inner conductor 24*i* of coaxial transmission line 24 through window or wall 16. In FIGS. 1*a* and 1*b*, transmission line 24 is a coaxial transmission line (coax) having an outer conductor 24*o* and inner conductor 24*i*. At least the inner conductor 24*i* penetrates through window 16 in a sealing manner.

Those skilled in the antenna arts know that coupling structures such as 23 and 25 are forms of antennas, which transduce electromagnetic energy from guided waves propagating in the transmission line into free or unguided waves, and which equally well transduce unguided waves into guided waves. Antennas are said to have "feed" ports. The term "feed" port is somewhat of a misnomer, having arisen when radio communications were in their infancy. It was not at that time recognized that the principles applicable to antennas for transmitting use were the same as the principles applicable to antennas in reception use, and the term "feed" came to be associated with the guided-wave connection to the antenna, regardless of its actual use. Thus, the "feed" or feed port of antenna 23 may be considered to be transmission line 22, and the "feed" or feed port of antenna 25 may be considered to be transmission line 24. Also, electromagnetic energy, whether constrained or not, is often referred to a "radio frequency" energy, regardless of its actual frequency, and irrespective of the fact that the term "radio frequency" has definitions which exclude electromagnetic energy of various frequencies. Language, once well established, changes slowly.

Thus, the arrangement of FIGS. 1*a* and 1*b* may be viewed as including a plasma (however generated or constrained, if at all) associated with a transmitting antenna and a receiving antenna. In order to determine the "plasma frequency," electromagnetic waves (radio frequencies or "RF") are applied to the feed point of the transmitting antenna 23 and are coupled, in greater or lesser amount, through the plasma 30 to the receiving antenna 25. The amount of RF energy leaving the plasma by way of receiving antenna 25 can be measured by means of simple instruments affixed to the "feed" of the receiving antenna. It should be noted that the transmitting and receiving nature of the antennas are not exclusive, since the energy transmitted into the plasma 30 by "transmitting" antenna 23 may be wholly or partially reflected by the plasma 30, and that portion reflected returns to the transmitting antenna 23. There being no real difference between transmitting and receiving antennas, the "transmitting" antenna 23 will "receive" the reflected energy, and couple it as a guided wave to its "feed" port and back through transmission line 22. A complete determination of the effects of the plasma on the electromagnetic radiation or RF at a given frequency may be made by applying a known amount of such energy-to the transmitting antenna 23, and determining how much of the energy is reflected by the plasma back into antenna 23, and how much of the energy is coupled through the plasma to antenna 25. The difference between these amounts is the loss or absorption by the plasma 30. A plasma having a particular frequency tends to reflect andor absorb electromagnetic energy having a frequency below the plasma frequency, and to transmit electromagnetic energy having a frequency greater than the plasma frequency with relatively low absorption. Thus, it is only necessary to perform the transmission/reflection test at a number of frequencies, whereby the plasma frequency is that frequency at which a transition between reflection/absorption and transmission occurs.

Figure 2:
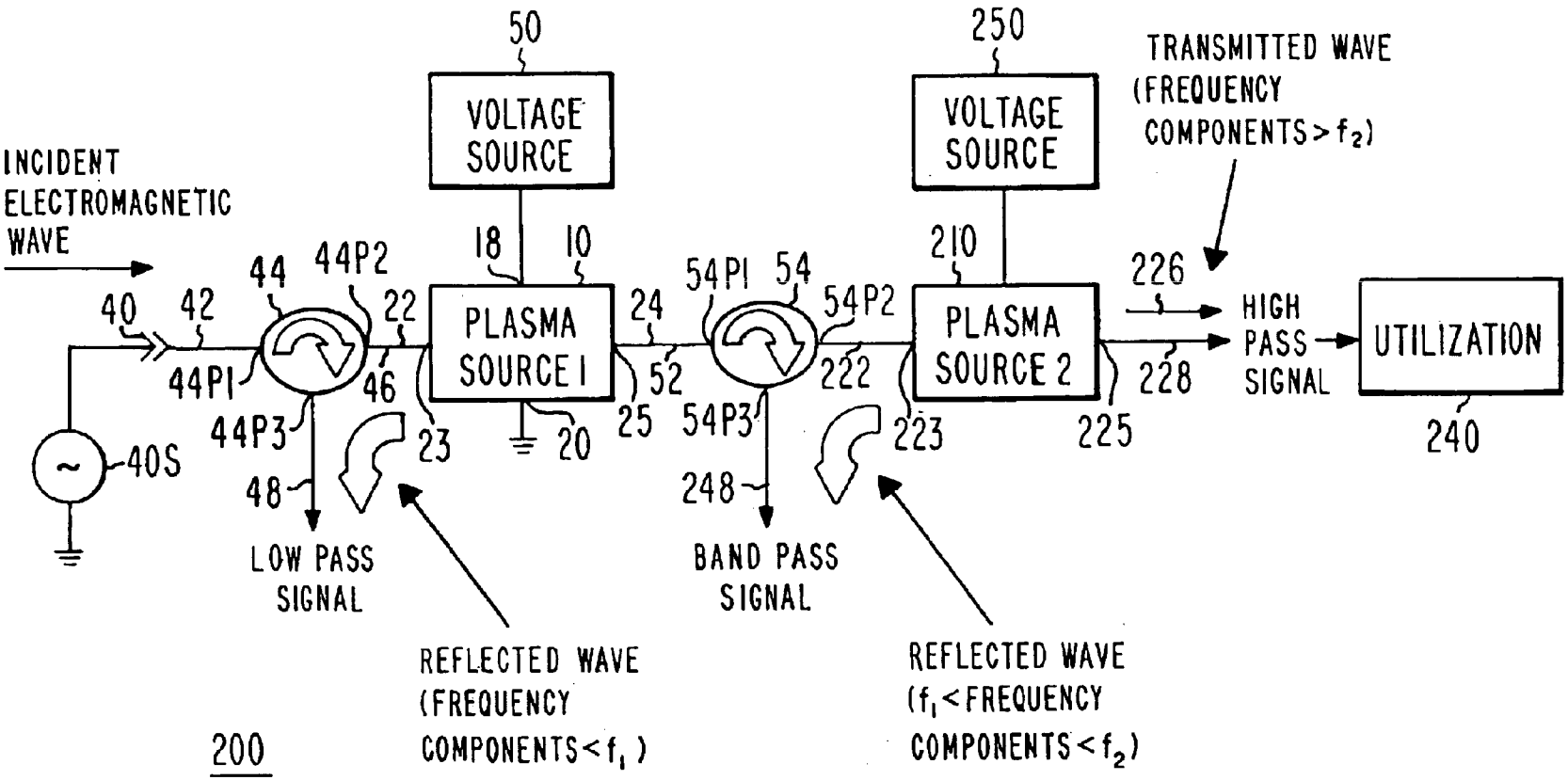
FIG. 2 is a simplified block diagram of an arrangement according to an aspect of the invention.

According to an aspect of the invention, at least first and second plasmas, having different plasma frequencies, are coupled in an RF path. FIG. 2 illustrates an RF circuit including two plasmas, designated 10 and 210. Plasmas 10 and 210 differ at least in that the plasma frequency of plasma 210 is higher than the plasma frequency of plasma 10. Plasma 10 has an "input" antenna 23 and an "output" antenna 25. Its electrode 20 is grounded and a source 50 of negative voltage is connected to its electrode 18. Plasma 210 is similar to plasma 10, and similarly has an "input" antenna 222 and an "output" antenna 225. Its electrode 220 is grounded, and its electrode 218 is connected to a source 250 of high negative voltage. In FIG. 2, an electromagnetic wave is applied to an input port 40 of a circuit 200, and flows by way of a transmission line 42 to a first port 44*p*1 of a circulator 44. Circulator 44 also includes a second port 44*p*2 and a third port 44*p*3.

Those skilled in the art know that a circulator, such as circulator 44 of FIG. 2, is a device for coupling signals applied to a first port, such as port 44*p*1, to a second port, such as 44*p*2 and not to the third port, such a 44*p*3. However, signal applied to the second port 44*p*2 flows to the third port 44*p*3, and not to the first port. Similarly, signal applied to the third port 44*p*3 flows to the first port 44*p*1 and not to the second port. Circulators can be broadband, in that they can be capable of operating correctly over an octave (2:1) bandwidth or more.

In the arrangement of FIG. 2, the electromagnetic energy or RF applied to input port 40 flows through transmission line 42, and following the operation as described for circulator 44, enters its first port 44*p*1, and flows to its second port 44*p*2. From port 44*p*2 of circulator 44, the RF flows through a transmission line 46, which may include that portion of transmission line 22 illustrated in FIGS. 1*a* and 1*b*, to antenna 23 of first plasma 10. Depending upon the relative frequencies of the RF or electromagnetic energy and the plasma, the electromagnetic energy introduced into first plasma 10 by antenna 23 will be reflected, absorbed, andor transmitted.

In general, that portion of the electromagnetic energy applied to input port 40 of FIG. 2 which is at a frequency below the plasma frequency of first plasma 10 will be reflected, and flow back along transmission lines 22/46 to second port 44*p*2 of circulator 44. Pursuant to the normal operation of the circulator 44, this reflected energy will be propagated to, and exit from, third port 44*p*3 of the circulator. The energy leaving port 44*p*3 may travel over a transmission line 48. The structure of FIG. 2 may be viewed as a low pass filter as to that portion of the applied energy applied to port 40 and exiting from port 44*p*3, where the "cutoff" frequency of the filter is the plasma frequency of first plasma 10.

That portion of the electromagnetic energy or RF which exits first plasma 10 of FIG. 1 by way of "output" antenna 25 proceeds over a transmission line 52, which may include a portion of transmission line 24 of FIGS. 1*a* and 1*b*. The electromagnetic energy propagating on transmission line arrives at the first port 54*p*1 of circulator 54. Circulator 54 operates in the same manner as that described for circulator 44. In short, energy arriving at or introduced into one of ports 54*p*1, 54*p*2, and 54*p*3 circulates exclusively to the next port 54*p*2, 54*p*3, and 54*p*1, respectively, which is to say that it does not flow to the other ports. Thus, electromagnetic energy arriving at first port 54*p*1 of circulator 54 circulates to, and leaves from, second port 54*p*2, from which it propagates over a transmission line designated 222 to an "input" antenna 223 of second plasma 210. The electromagnetic energy arriving at antenna 223 is reflected if below the plasma frequency of second plasma 210, or propagates through second plasma 210 if above the plasma frequency.

If the frequency of the electromagnetic energy arriving at or impinging on antenna 223 of FIG. 2 is below the plasma frequency of second plasma 210, the energy is reflected and returns by way of transmission line 222 toward port 54*p*2 of second circulator 54. The reflected energy enters port 54*p*2, and is circulated to, and exits from port 54*p*3. The energy exiting port 54*p*3 of circulator 54 must have a frequency above the plasma frequency of first plasma 10, because it had to pass through plasma 10 in order to get to plasma 210. The energy exiting port 54*p*3 must also have a frequency lower than the plasma frequency of second plasma 210, because it had to reflect from second plasma 210 in order to exit from port 54*p*3. Thus, the structure of FIG. 2 may be seen to provide a band-pass or bandpass characteristic as between port 40 and port 54*p*3, where the edges of the band of the filter are the plasma frequencies of first plasma 10 and second plasma 210.

On the other hand, if the frequency of the electromagnetic energy arriving at or impinging on antenna 223 of FIG. 2 is above the plasma frequency of second plasma 210, it passes through second plasma 210 to arrive at output antenna or coupler 225, and proceeds in the direction of arrow 226 over a transmission line 228 to a utilization device (not illustrated). Those skilled in the art realize that the utilization device should have an impedance, at least at frequencies above the plasma frequency of second plasma 210, in order to avoid unwanted reflections from the utilization device back into second plasma source 210.

Similarly, those skilled in the art recognize that some reflections take place at all discontinuities in a transmission line or transmission path, and suitable impedance transformation or adjustment may be required in order to obtain acceptable operation in the desired frequency ranges. Such impedance transformations are well known in the art, and require no further description.

In operation of the device of FIG. 2, all frequency components, namely those frequency components lying below the first plasma 10 frequency, above the second plasma 210 frequency, and between the first and second plasma frequencies, pass through non-frequency-selective circulator 44 to first plasma 10. Those frequency components lying below the first plasma frequency are reflected back to circulator 44, and are circulated to circulator "output" port 44*p*3, and become available on transmission line or path 48. Those frequency components lying above the first plasma frequency pass through first plasma 10, and also from port 54*p*1 to port 54*p*2 of circulator 54 to second plasma 210. Those frequency components lying above the first plasma 10 frequency but below the frequency of second plasma 210 are reflected by second plasma 210, and return to port 54*p*2 of circulator 54, from which they are circulated to port 54*p*3 and onto a transmission line or transmission path 248. Those frequency components of the signal applied to port 40 which lie above the frequency of the second plasma are not reflected by second plasma 210, but instead pass through second plasma 210 to its output port 225, and become available on output transmission path 228. In summary, the structure 200 of FIG. 2 acts as a combination low pass, bandpass, and high pass filter, and can of course be used for any one or any two of the three of these functions.

Thus, a frequency-sensitive apparatus (200) according to an aspect of the invention comprises a first path (44, 46, 52, 54, 222, 228) for the flow of electromagnetic energy, and a first plasma (10) lying in the first path (44, 46, 52, 54, 222, 228). The first plasma (10) has a first plasma (10) frequency. A second plasma (210) lies in the first path (44, 46, 52, 54, 222, 228). The second plasma (210) has a second plasma (210) frequency, different from the first plasma (10) frequency. In a particular embodiment of the apparatus according to this aspect of the invention, an electromagnetic energy port.(54*p*3) is coupled to the first path (44, 46, 52, 54, 222, 228) at a location lying between the first (10) and second (210) plasmas. In another embodiment, a first circulator (44) is provided. The first circulator (44) defines first (44*p*1), second (44*p*2), and third (44*p*3) ports, and first, second, third paths for the flow of circulator electromagnetic energy from the first port (44*p*1) to the second port (44*p*2), from the second port (44*p*2) to the third port (44*p*3), and from the third port (44*p*3) to the first port (44*p*1), respectively. The first path (44, 46, 52, 54, 222, 228) for the flow of electromagnetic energy of the first circulator (44) lies in the first path (44, 46, 52, 54, 222, 228) for the flow of electromagnetic energy, at a location along the first path (44, 46, 52, 54, 222, 228) for the flow of electromagnetic energy which lies between the first (10) and second (210) plasmas. In another embodiment of this aspect of the invention, a second circulator (54) is provided, with the second circulator (54) defining fourth (54*p*1), fifth (54*p*2), and sixth (54*p*3) ports, and fourth (54*p*1), fifth (54*p*2), and sixth (54*p*3) paths for the flow of second circulator (54) electromagnetic energy from the fourth port (54*p*1) to the fifth port (54*p*2), from the fifth port (54*p*2) to the sixth port (54*p*3), and from the sixth port (54*p*3) to the fourth port (54*p*1), respectively, of the second circulator (54). The fourth port (54*p*1) is coupled to the first path (44, 46, 52, 54, 222, 228) for the flow of electromagnetic energy at a location, relative to the first plasma (10), which is remote from the first circulator (44). In particular embodiments of this aspect of the invention, a first voltage source (50) is coupled to the first plasma (10) for maintaining the first plasma (10) at the first plasma (10) frequency, and a second voltage source (250) is coupled to the second plasma (210) for maintaining the second plasma (210) at the second plasma (210) frequency. In one application of an apparatus according to this first aspect of the invention, a source (40*s*) of electromagnetic energy is coupled to the first path (44, 46, 52, 54, 222, 228) at a location adjacent the first plasma (10), for transmitting electromagnetic waves along the path (44, 46, 52, 54, 222, 228) toward the first plasma (10) and the second plasma (210). In a particular application, the electromagnetic waves transmitted by the source of electromagnetic energy (40*s*) include a component at a frequency lower than the plasma frequency of the first plasma (10), whereby the component of the electromagnetic waves transmitted by the source of electromagnetic energy tends to be reflected by the first plasma (10). In another particular application of the apparatus according to this aspect of the invention, the electromagnetic waves transmitted by the source (40*s*) of electromagnetic energy include a component at a frequency lying between the plasma frequency of the first plasma (10) and the plasma frequency of the second plasma (210), whereby the component of the electromagnetic waves transmitted by the source of electromagnetic energy tends to be passed by the first plasma (10) and reflected by the second plasma (210). In this particular application, it may be advantageous if the apparatus further comprises electromagnetic signal coupling means (54) coupled to the first path (44, 46, 52, 54, 222, 228) at a location lying between the first (10) and second (210) plasmas, for extracting the component of the electromagnetic energy at a frequency lying between the plasma frequency of the first plasma (10) and the plasma frequency of the second plasma (210). In one version, the electromagnetic signal coupling means (54) is directional. It may be a directional coupler. In yet another application of the apparatus according to this aspect of the invention, the electromagnetic waves transmitted by the source (40*s*) of electromagnetic energy include a component at a frequency lying above the plasma frequencies of the first plasma (10) and the second plasma (210), whereby the component of the electromagnetic waves transmitted by the source of electromagnetic energy tends to be passed by the first and second plasma (210)s. In such a version, the apparatus may advantageously include utilization means (240) coupled to the first path (44, 46, 52, 54, 222, 228) at a location relative to the second plasma (210) which is remote from the first plasma (10). In an application of the apparatus according to this aspect of the invention, where the electromagnetic waves transmitted by the source of electromagnetic energy include components having frequencies lying above the plasma frequency of the first plasma (10) and other components having frequencies lying above the plasma frequency of the second plasma (210) the apparatus according to this aspect of the invention may advantageously include electromagnetic signal coupling means (54), which may be directional, coupled to the first path (44, 46, 52, 54, 222, 228) at a location lying between the first (10) and second (210) plasmas, for extracting the component of the electromagnetic energy at a frequency lying between the plasma frequency of the first plasma (10) and the plasma frequency of the second plasma (210). It may further advantageously include signal utilization means (240) coupled to the first path (44, 46, 52, 54, 222, 228) at a location adjacent the second plasma (210) and remote from the first plasma (10), for utilizing the component of the electromagnetic energy at a frequency lying above the plasma frequency of the second plasma (210). If the electromagnetic signal coupling (54) means comprises a directional coupler, the coupler may define a path between first (54*p*1) and second (54*p*2) ports, and a third port (54*p*3), with the path between first (54*p*1) and second (54*p*2) ports lying in the first path (44, 46, 52, 54, 222, 228) at the location lying between the first (10) and second (210) plasmas, for coupling to the third port (54*p*3) of the directional coupler (54) the electromagnetic energy at a frequency lying between the plasma frequency of the first plasma (10) and the plasma frequency of the second plasma (210) which reflect from the second plasma (210). For those applications of the apparatus according to this aspect of the invention, where the source of electromagnetic energy further generates waves with components at frequencies below the plasma frequency of the first plasma (10), the apparatus may include coupling means (44) lying between the source (40*s*) of electromagnetic energy and the first plasma (10), for extracting that component of the electromagnetic energy with components at frequencies below the plasma frequency of the first plasma (10) which are reflected by the first plasma (10).

According to another aspect of the invention, a frequency-sensitive apparatus comprises a first plasma (10) defining first (23) and second ports (25), and a path for the flow of electromagnetic energy between the first (23) and second (25) ports of the first plasma (10) at frequencies lying above a plasma frequency of the first plasma (10). A second plasma (210) defines first (223) and second (225) ports, and a path for the flow of electromagnetic energy between the first (223) and second (225) ports of the second plasma (210) at frequencies lying above a plasma frequency of the second plasma (210). A source (40*s*) of electromagnetic energy generates electromagnetic waves including at least one component. The component has a frequency which is one of (a) below the first plasma (10) frequency, (b) between the first (10) and second (210) plasma frequencies, and (c) above the second plasma (210) frequency. A first directional coupling means (44) is provided. The first directional coupling means (44) includes first (44*p*1), second (44*p*2), and third (44*p*3) ports, for coupling signal in a directional manner, namely from the first port (44*p*1) exclusively to the second port (44*p*2), from the second port (44*p*2) exclusively to the third port (44*p*3), and from the third port (44*p*3) exclusively to the first port (44*p*1). The second port (44*p*2) of the first directional coupling means (44) is coupled to the first port (23) of the first plasma (10), for coupling to the third port (44*p*3) of the first directional coupling means (44) at least that component of the electromagnetic energy which reflects from the first plasma (10). The apparatus according to this aspect of the invention also includes second directional coupling means (54) including first (54*p*1), second (54*p*2), and third (54*p*3) ports, for coupling signal in a directional manner from the first port (54*p*1) exclusively to the second port (54*p*2), from the second port (54*p*2) exclusively to the third port (54*p*3), and from the third. (54*p*3) port exclusively to the first port (54*p*1). The first port (54*p*1) of the second directional coupling means (54) is coupled to the second port (25) of the first plasma (10), and the second port (54*p*2) of the second directional coupling means (54) is coupled to the first port (223) of the second plasma (210), for coupling to the third port (54*p*3) of the second directional coupling means (54) at least that component of the electromagnetic waves which reflects from the second plasma (210). In a particular version of this aspect of the invention, the apparatus further comprises utilization means (240) coupled to the second port (225) of the second plasma (210), for utilizing those components of the electromagnetic wave passing through the second plasma (210).

An apparatus according to another aspect of the invention includes a first plasma (10), and a first radio-frequency electromagnetic coupling means (23, 25) coupled to the first plasma (10), for defining first (23) and second (25) radio-frequency electromagnetic ports of the first plasma (10). This apparatus also includes a second plasma (210), and second radio-frequency electromagnetic coupling means (223, 225) coupled to the second plasma (210), for defining first (223) and second (225) radio-frequency electromagnetic ports of the second plasma (210). The apparatus according to this other aspect of the invention also includes a radio-frequency electromagnetic path (52, 54, 222) extending from the second port (25) of the first plasma (10) to the first port (223) of the second plasma (210), for coupling radio frequencies electromagnetic waves between the second port (25) of the first plasma (10) and the first port (223) of the second plasma (210). In a version of this other aspect of the invention, the radio-frequency electromagnetic path (52, 54, 222) comprises a directional coupler (54). In this version, the directional coupler (54) may comprise first (54*p*1), second (54*p*2), and third (54*p*3) ports, and it may couple (a) signals applied to the first port (54*p*1) of the directional coupler (54) to the second port (54*p*2) of the directional coupler (54), (b) signals applied to the second port (54*p*2) of the directional coupler (54) to the third port (54*p*3) of the directional coupler (54), and (c) signals applied to the third port (54*p*3) of the directional coupler (54) to the first port (54*p*1) of the directional coupler (54). The first port (54*p*1) of the directional coupler (54) is coupled to the second port (25) of the first plasma (10), and the second port (54*p*2) of the directional coupler (54) is coupled to the first port (223) of the second plasma (210), for coupling to the third port (54*p*3) of the directional coupler (54) electromagnetic signals reflected from the first port (223) of the second plasma (210). A second directional coupler (44) may be used. The second directional coupler (44) may define first (44*p*1), second (44*p*2), and third (44*p*3) ports, for coupling (a) signals applied to the first port (44*p*1) of the second directional coupler (44) to the second port (44*p*2) of the second directional coupler (44), (b) signals applied to the second port (44*p*2) of the second directional coupler (44) to the third port (44*p*3) of the second directional coupler (44), and (c) signals applied to the third port (44*p*3) of the second directional coupler (44) to the first port (44*p*1) of the second directional coupler (44). The second port (44*p*2) of the second directional coupler (44) is coupled to the first port (23) of the first plasma (10), for coupling to the third port (44*p*3) of the second directional coupler (44) signals reflected from the first port (23) of the first plasma (10).

What is claimed is:

1. A frequency-sensitive apparatus, comprising:

a first path for flow of electromagnetic energy;

a first plasma, not sustained by said electromagnetic energy, lying in said first path, said first plasma having a first plasma frequency; and a second plasma, not sustained by said electromagnetic energy, lying in said first path, said second plasma having a second plasma frequency, different from said first plasma frequency.

2. The apparatus according to claim 1, further comprising an electromagnetic port coupled to said first path at a location lying between said first and second plasmas.

3. The apparatus according to claim 1, further comprising a first voltage source coupled to said first plasma for maintaining said first plasma at said first plasma frequency.

4. The apparatus according to claim 3, further comprising a second voltage source coupled to said second plasma for maintaining said second plasma at said second plasma frequency.

5. The apparatus according to claim 1, further comprising a source of electromagnetic energy coupled to said first path at a location adjacent said first plasma, for transmitting electromagnetic waves along said path toward said first plasma and said second plasma.

6. The apparatus according to claim 5, wherein said electromagnetic waves transmitted by said source of electromagnetic energy include a component at a frequency lower than said plasma frequency of said first plasma, whereby said component of said electromagnetic waves transmitted by said source of electromagnetic energy tends to be reflected by said first plasma.

7. The apparatus according to claim 6, further comprising electromagnetic signal coupling means coupled to said first path at a location lying between said first and second plasmas, for extracting said component of said electromagnetic energy at a frequency lying between said plasma frequency of said first plasma and said plasma frequency of said second plasma.

8. The apparatus according to claim 7, wherein said electromagnetic signal coupling means is directional.

9. The apparatus according to claim 8, wherein said electromagnetic signal coupling means is a directional coupler.

10. The apparatus according to claim 5, wherein said electromagnetic waves transmitted by said source of electromagnetic energy include a component at a frequency lying between said plasma frequency of said first plasma and said plasma frequency of said second plasma, whereby said component of said electromagnetic waves transmitted by said source of electromagnetic energy tend to be passed by said first plasma and reflected by said second plasma.

11. The apparatus according to claim 5, wherein said electromagnetic waves transmitted by said source of electromagnetic energy include a component at a frequency lying above said plasma frequency of said first plasma and said plasma frequency of said second plasma, whereby said component of said electromagnetic waves transmitted by said source of electromagnetic energy tend to be passed by said first and second plasmas.

12. The apparatus according to claim 11, further comprising utilization means coupled to said first path at a location relative to said second plasma which is remote from said first plasma.

13. The apparatus according to claim 5, wherein said electromagnetic waves transmitted by said source of electromagnetic energy include components having frequencies lying above said plasma frequency of said first plasma and other components having frequencies lying above said plasma frequency of said second plasma, and further comprising;

electromagnetic signal coupling means coupled to said first path at a location lying between said first and second plasmas, for extracting said component of said electromagnetic energy at a frequency lying between said plasma frequency of said first plasma and said plasma frequency of said second plasma; and signal utilization means coupled to said first path at a location adjacent said second plasma and remote from said first plasma, for utilizing said component of said electromagnetic energy at a frequency lying above said plasma frequency of said second plasma.

14. The apparatus according to claim 13, wherein said electromagnetic signal coupling means is directional.

15. The apparatus according to claim 14, wherein said electromagnetic signal coupling means comprises a directional coupler defining a path between first and second ports, and a third port, said path between first and second ports lying in said first path at said location lying between said first and second plasmas, for coupling to said third port of said directional coupler said electromagnetic energy at a frequency lying between said plasma frequency of said first plasma and said plasma frequency of said second plasma which reflect from said second plasma.

16. The apparatus according to claim 15, wherein said source of electromagnetic energy further generates waves with components at frequencies below said plasma frequency of said first plasma, said apparatus further comprising:

coupling means lying between said source of electromagnetic energy and said first plasma, for extracting that component of said electromagnetic energy with components at frequencies below said plasma frequency of said first plasma which are reflected by said first plasma.

17. A frequency-sensitive apparatus, comprising:

a first path for flow of electromagnetic energy;

a first plasma lying in said first path, said first plasma having a first plasma frequency; and a second plasma lying in said first path, said second plasma having a second plasma frequency, different from said first plasma frequency; and further comprising a first circulator defining first, second, and third ports, and first, second, and third paths for flow of circulator electromagnetic energy from said first port to said second port, from said second port to said third port, and from said third port to said first port, respectively, of said first circulator, said first path for flow of electromagnetic energy of said first circulator lying in said first path for flow of electromagnetic energy at a location along said first path for flow of electromagnetic energy lying between said first and second plasmas.

18. The apparatus according to claim 17, further comprising a second circulator defining fourth, fifth, and sixth ports, and fourth, fifth, and sixth paths for flow of second circulator electromagnetic energy from said fourth port to said fifth port, from said fifth port to said sixth port, and from said sixth port to said fourth port, respectively, of said second circulator, said fourth port being coupled to said first path for flow of electromagnetic energy at a location, relative to said first plasma, which is remote from said first circulator.

19. A frequency-sensitive apparatus, comprising:

a first plasma defining first and second electromagnetic ports, and a path for flow of electromagnetic energy between said first and second ports of said first plasma at frequencies lying above a plasma frequency of said first plasma;

a second plasma defining first and second electromagnetic ports, and a path for flow of electromagnetic energy between said first and second ports of said second plasma at frequencies lying above a plasma frequency of said second plasma;

a source of electromagnetic energy for generating electromagnetic waves including at least one component, said component having a frequency which is one of (a) below said first plasma frequency, (b) between said first and second plasma frequencies, and (c) above said second plasma frequency;

first directional coupling means including first, second, and third ports, for coupling signal in a directional manner from said first port exclusively to said second port, from said second port exclusively to said third port, and from said third port exclusively to said first port, said second port of said first directional coupling means being coupled to said first port of said first plasma, for coupling to said third port of said first directional coupling means at least that component of said electromagnetic energy which reflects from said first plasma;

second directional coupling means including first, second, and third ports, for coupling signal in a directional manner from said first port exclusively to said second port, from said second port exclusively to said third port, and from said third port exclusively to said first port, said first port of said second directional coupling means being coupled to said second port of said first plasma, and said second port of said second directional coupling means being coupled to said first port of said second plasma, for coupling to said third port of said second directional coupling means at least that component of said electromagnetic waves which reflects from said second plasma.

20. The apparatus according to claim 19, further comprising utilization means coupled to said second port of said second plasma, for utilizing those components of said electromagnetic wave passing through said second plasma.

21. A apparatus, comprising:

a first plasma sustained by an energy source coupled to said first plasma;

first radio-frequency electromagnetic coupling means coupled to said first plasma, for defining first and second radio-frequency electromagnetic ports of said first plasma for flow of electromagnetic energy other than that of said sustaining energy source coupled to said first plasma;

a second plasma sustained by an energy source coupled to said second plasma;

second radio-frequency electromagnetic coupling means coupled to said second plasma, for defining first and second radio-frequency electromagnetic ports of said second plasma for flow of electromagnetic energy other than that of said sustaining energy source coupled to said second plasma; and a radio-frequency electromagnetic path extending from said second port of said first plasma to said first port of said second plasma, for coupling radio frequency electromagnetic waves between said second port of said first plasma and said first port of said second plasma.

22. The apparatus according to claim 21, wherein said radio-frequency electromagnetic path comprises a directional coupler.

23. The apparatus according to claim 22, wherein said directional coupler comprises first, second, and third ports, and said directional coupler couples signals applied to said first port of said directional coupler to said second port of said directional coupler, couples signals applied to said second port of said directional coupler to said third port of said directional coupler, and couples signals applied to said third port of said directional coupler to said first port of said directional coupler, said first port of said directional coupler being coupled to said second port of said first plasma, and said second port of said directional coupler being coupled to said first port of said second plasma, for coupling to said third port of said directional coupler electromagnetic signals reflected from said first port of said second plasma.

24. The apparatus according to claim 23, further comprising a second directional coupler, said second directional coupler defining first, second, and third ports, for coupling signals applied to said first port of said second directional coupler to said second port of said second directional coupler, coupling signals applied to said second port of said second directional coupler to said third port of said second directional coupler, and coupling signals applied to said third port of said second directional coupler to said first port of said second directional coupler, said second port of said second directional coupler being coupled to said first port of said first plasma, for coupling to said third port of said second directional coupler signals reflected from said first port of said first plasma.

25. A frequency-sensitive apparatus, comprising:

a first path for flow of electromagnetic energy;

a first plasma lying in said first path, said first plasma having a first plasma frequency; and a second plasma lying in said first path, said second plasma having a second plasma frequency, different from said first plasma frequency; and a source of electromagnetic energy coupled to said first path at a location adjacent said first plasma, for transmitting electromagnetic waves, including a component at a frequency lower than said plasma frequency of said first plasma, along said path toward said first plasma and said second plasma, whereby said component of said electromagnetic waves transmitted by said source of electromagnetic energy tends to be reflected by said first plasma.

26. The apparatus according to claim 25, wherein said electromagnetic signal coupling means is directional.

27. The apparatus according to claim 26, wherein said electromagnetic signal coupling means is a directional coupler.

28. A frequency-sensitive apparatus, comprising:

a first path for flow of electromagnetic energy;

a first plasma lying in said first path, said first plasma having a first plasma frequency; and a second plasma lying in said first path, said second plasma having a second plasma frequency, different from said first plasma frequency;

a source of electromagnetic energy coupled to said first path at a location adjacent said first plasma, for transmitting electromagnetic waves, including components having frequencies lying above said plasma frequency of said first plasma and other components having frequencies lying above said plasma frequency of said second plasma, along said path toward said first plasma and said second plasma;

electromagnetic signal coupling means coupled to said first path at a location lying between said first and second plasmas, for extracting said component of said electromagnetic energy at a frequency lying between said plasma frequency of said first plasma and said plasma frequency of said second plasma; and signal utilization means coupled to said first path at a location adjacent said second plasma and remote from said first plasma, for utilizing said component of said electromagnetic energy at a frequency lying above said plasma frequency of said second plasma.

29. The apparatus according to claim 28 wherein said electromagnetic signal coupling means is directional.

30. The apparatus according to claim 28, wherein said electromagnetic signal coupling means comprises a directional coupler defining a path between first and second ports, and a third port, said path between first and second ports lying in said first path at said location lying between said first and second plasmas, for coupling to said third port of said directional coupler said electromagnetic energy at a frequency lying between said plasma frequency of said first plasma and said plasma frequency of said second plasma which reflect from said second plasma.

31. The apparatus according to claim 30, wherein said source of electromagnetic energy further generates waves with components at frequencies below said plasma frequency of said first plasma, said apparatus further comprising:

coupling means lying between said source of electromagnetic energy and said first plasma, for extracting that component of said electromagnetic energy with components at frequencies below said plasma frequency of said first plasma which are reflected by said first plasma.

32. An apparatus, comprising:

a first plasma defining first and second electromagnetic ports and an energizing port;

a first source of electrical energy coupled to said energizing port of said first plasma for sustaining said first plasma at a first plasma frequency;

a second plasma defining at least a first electromagnetic port and an energizing port;

a second source of electrical energy coupled to said energizing port of said second plasma for sustaining said second plasma at a second plasma frequency different from, and greater than, said first plasma frequency;

a connecting path for the flow of electromagnetic energy, said connecting path extending from said second electromagnetic port of said first plasma to said first electromagnetic port of said second plasma; and a source of electromagnetic energy at a frequency which is one of (a) lower than said first plasma frequency and (b) lies between said first plasma frequency and said second plasma frequency, said source of electromagnetic energy being coupled to said first electromagnetic port of said first plasma, whereby electromagnetic energy applied to said first electromagnetic port of said first plasma at said frequency lower than said first plasma frequency is reflected by said first plasma, and electromagnetic energy applied to said first electromagnetic port of said first plasma at said frequency lying between said first plasma frequency and said second plasma frequency is transmitted through said first plasma and reflected by said second plasma.

33. The apparatus of claim 32, wherein:

said second plasma further comprises a second electromagnetic port; and said source of electromagnetic energy further generates said energy at a frequency which lies above said second plasma frequency, whereby said electromagnetic energy applied to said first electromagnetic port of said first plasma at said frequency above said second plasma frequency is transmitted through said first and second plasmas and exits from said second electromagnetic port of said second plasma.

* * * * *